United States Patent [19]

Horowitz

[11] 4,315,697

[45] Feb. 16, 1982

[54] CORE FOR A MODULAR FISCAL YEAR ACCOUNT BOOK

[76] Inventor: Louis Horowitz, 100 Kings Point Dr., Apt. # 1610, North Miami Beach, Fla. 33160

[21] Appl. No.: 130,317

[22] Filed: Mar. 14, 1980

Related U.S. Application Data

[63] Continuation-in-part of Ser. No. 28,525, Apr. 9, 1979, abandoned.

[51] Int. Cl.[3] ..... B42D 5/00; B42D 12/02

[52] U.S. Cl. ..... 402/79; 11/1 R; 281/38; 283/66 R

[58] Field of Search ..... 282/29 R, 29 A, 26; 283/66 R, 66 A; 402/79, 503; 11/1 AD; 281/2, 15 R, 21 R, 38, 40, 41; 428/200

[56] References Cited

U.S. PATENT DOCUMENTS

| | | | |
|---|---|---|---|
| 663,639 | 12/1900 | Rand | 283/42 |
| 1,127,051 | 2/1915 | McCormick | 283/63 A |
| 1,349,577 | 8/1920 | Nankervis | 402/64 |
| 1,571,299 | 2/1926 | Pitt | 402/61 |
| 1,910,324 | 5/1933 | Dawson | 402/64 |
| 2,065,324 | 12/1936 | Brisendine | 281/21 R |
| 2,192,268 | 3/1940 | Lane et al. | 281/21 R |
| 2,869,898 | 1/1959 | Martin | 282/27 R |
| 3,092,401 | 6/1963 | Steidinger | 282/11.5 A |
| 3,706,626 | 12/1972 | Smith et al. | 282/28 R X |
| 4,214,029 | 7/1980 | Barnes | 428/200 |

FOREIGN PATENT DOCUMENTS

| | | | |
|---|---|---|---|
| 2340411 | 4/1974 | Fed. Rep. of Germany | 11/1 R |
| 6711263 | 2/1969 | Netherlands | 11/1 AD |

*Primary Examiner*—Paul A. Bell
*Assistant Examiner*—John S. Brown
*Attorney, Agent, or Firm*—Henderson & Sturm

[57] ABSTRACT

This invention relates to the field of bookkeeping equipment and specifically to the area of modular fiscal year account books, wherein the user is provided with a self contained account ledger insert, which will accommodate all of the entries for a fiscal year, and will contain a complete record of business transactions for auditing and accounting purposes.

3 Claims, 4 Drawing Figures

CORE FOR A MODULAR FISCAL YEAR ACCOUNT BOOK

BACKGROUND OF THE INVENTION

This application is a continuation-in-part application of co-pending Ser. No. 028,525 filed Apr. 9, 1979 now abandoned.

While the practice varies somewhat from place to place, and with the type of business involved, conventional bookkeeping practice has generally involved a substantial number of separate account books generally called journals or ledgers. Frequently, separate account books are kept for cash receipts, cash disbursements, purchases, sales, a general ledger, etc., as well as a volume in which journal entries are made. Generally, these books are bulky, are spread about the accounting department of a business and are cumbersome. This practice persists frequently in small businesses, probably because of general bookkeeping tradition and practice.

Over the years, there has been a significant amount of inventive activities directed to bookkeeping and intended to simplify comparisions, prevent errors in transcribing figures, simplify the comparision of figures, to eliminate labor in copying over column headings, and the like. Examples include Schuessler, U.S. Pat. No. 3,081,112 which provides for folding of pages for comparison, and involved the use of correlator sheets, carbon paper and additional entries. Similarly, Lilly, U.S. Pat. No. 1,885,928 involves a comparison means involving repeated folding over sheets in a shingled fashion to expose a series of similar columns. Sterling, U.S. Pat. No. 1,625,105 involves using sheets of different sizes and with corresponding columns for much the same purpose. Using sheets of different sizes has also been employed in DeRham, et al, U.S. Pat. No. 3,269,975, which also employs pressure sensitive strips affixed to the column headings. Matthews, U.S. Pat. No. 1,478,975, uses such strips of paper to actually make the entries which are intended by the inventor to be attached to the appropriate columns in the account book. In Engelberg, U.S. Pat. No. 1,252,333, the column headings are actually made a part of the book cover and raised. Davis, et al., U.S. Pat. No. 2,046,151, also utilizes a shingled configuration of pages for the comparison of columns in a configuration that would undoubtedly prove to be of substantial size. Finally, Kalada, U.S. Pat. No. 1,761,078, also utilizes a folding method to compare figures on one page with the figures on the following page as a means of improving upon the accuracy in transcribing figures from one page to another.

However, none of this inventive activity is directed to the area of combining a number of different accounts into the single modular unit that many of the smaller businesses would find convenient, inexpensive and entirely appropriate to their needs, whether that bookkeeping is done manually, with the aid of bookkeeping machines, or utilizing the printouts of computers. Moreover, the separate columns generally contain figures for a series of years. In such figures were kept in a single modular unit, with a new module initiated for each fiscal year, all figures necessary for the preparation of annual or other quarterly reports to officers, directors and shareholders, would be in a single place with out irrelevant figures from preceding years, and the records for the year would also be in a single place for purposes of producing same for an Internal Revenue Service (IRS) audit of a given year's operations.

SUMMARY OF THE INVENTION

With the foregoing in mind, it is a principal object to provide a modular fiscal year account book which will be suitable to keep a great many of the accounts now separately kept in conventional bookkeeping practice, but will allow the entries to be made in a single convenient annual or other periodic modular unit.

Another object of the invention is to maintain the periodic records of a business in a modular unit of manageable size for small and medium sized businesses, to eliminate the substantial expense of purchasing multiple volumes.

A further object of the invention is to maintain current periodic records together and eliminate the bulk and inconvenience of carrying around in an accounting department, records from prior periods that are irrelevant to present operations.

Another object of the invention is to maintain records for a given fiscal period in one place to be able to produce same for an IRS audit without the necessity of producing records from other years which have not been requested for the audit, thereby limiting the audit to the specific periods requested Still another object of the invention is to provide a completely flexible modular fiscal year accout book which, through the use of a unique construction and cooperation between the individual sheets, will be flexible, expandable and adaptable to any different type of business without significent expense, and which will further provide a complete bound record when the fiscal period has elasped.

Other objects and advantages will become apparent to those skilled in the art upon reading the following descriptions of the invention and upon reference to the drawings.

In accordance with the invention there is provided a durable binder of appropriate size, generally having hinged covers with a post construction that may be expanded to accommodate additional sheets or separating means as needed. Contained therein will be the modular unit comprising a plurality of sheets having lines and columns appropriate to various bookkeeping functions as hereinafter described. The sheets of paper will generally be of substantially the same size as the binding and cover, but may be ruled or lined in accordance with the differing bookkeeping accounts intended.

The invention further incorporates a series of separators having tabs or other means to identify the contents of the various divisions within the module, each of which can be identified with a different account. These tabs may be marked with such headings as "cash received", "disbursements", "sales", "liabilities", "general journal", and the like. As noted above, each of the accounts will include paper ruled appropriately for that type of account, but will preferably be of uniform size with paper utilized for the other accounts. In addition, since the binder will preferably be of the type that opens for the insertion or removal of papers, each of the sheets which comprise the module will be punched to accommodate the binder retaining means.

The invention will be better understood after reading the following detailed description of the embodiments thereof with reference to the appended drawings, in which:

DETAILED DESCRIPTION OF THE PREFERRED EMBODIMENT

Figure 1:
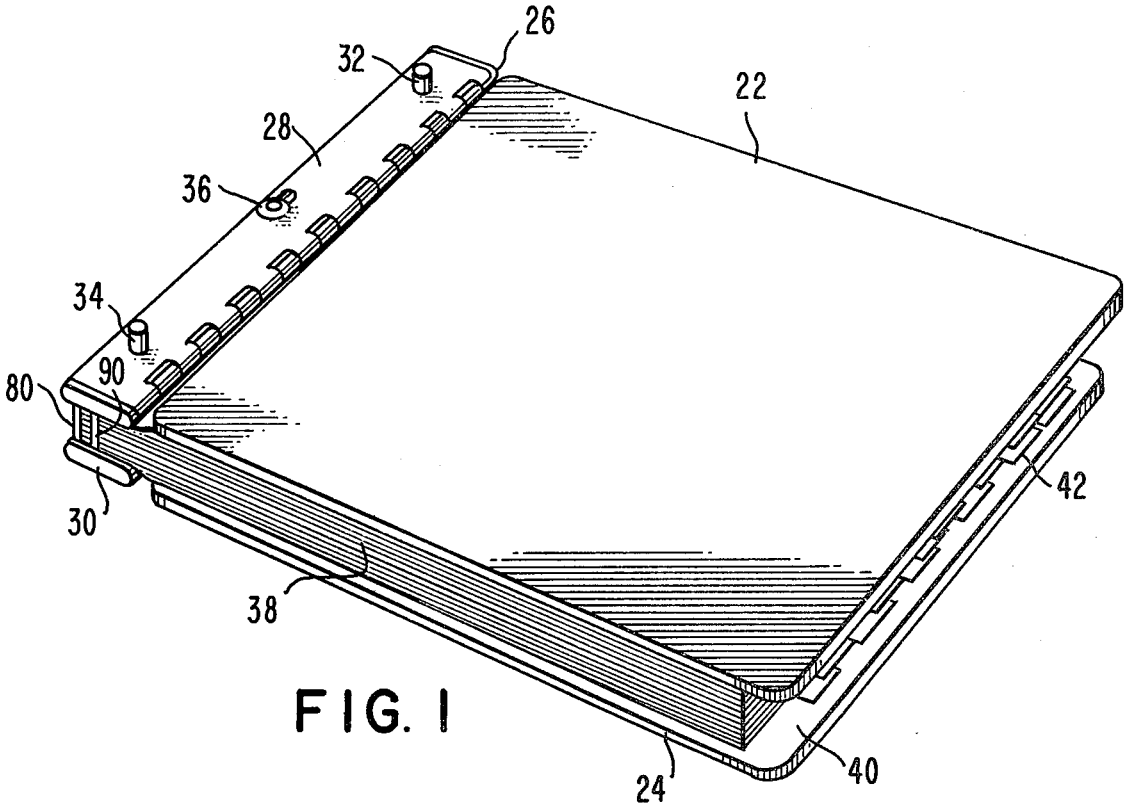
FIG. 1 is a perspective view of the modular fiscal year account book as it would appear inserted within a typical binder.

Turning to FIG. 1, a typical binder which would normally be employed with this invention is designated generally as 20, and comprises a pair of durable hard covers 22 and 24 connected by hinges 26 to upper 28 and lower 30 halves of the binder 20. The lower portion of the binder 30 includes posts 32 and 34 which penetrate the upper portion of the binder 28, and further includes a slidable locking means 36.

The module 38 comprises a multiplicity of uniform sized sheets 48 and separators 44 having a plurality of apertures 70 adapted to receive the posts 32 and 34 to secure the module 38 within the binder 20. The pages 48 and separators 44 will generally be shorter than the covers at 40 to make room for index tabs 42 within the covers 22 and 24, thereby protecting said index tabs 42.

Figure 2:
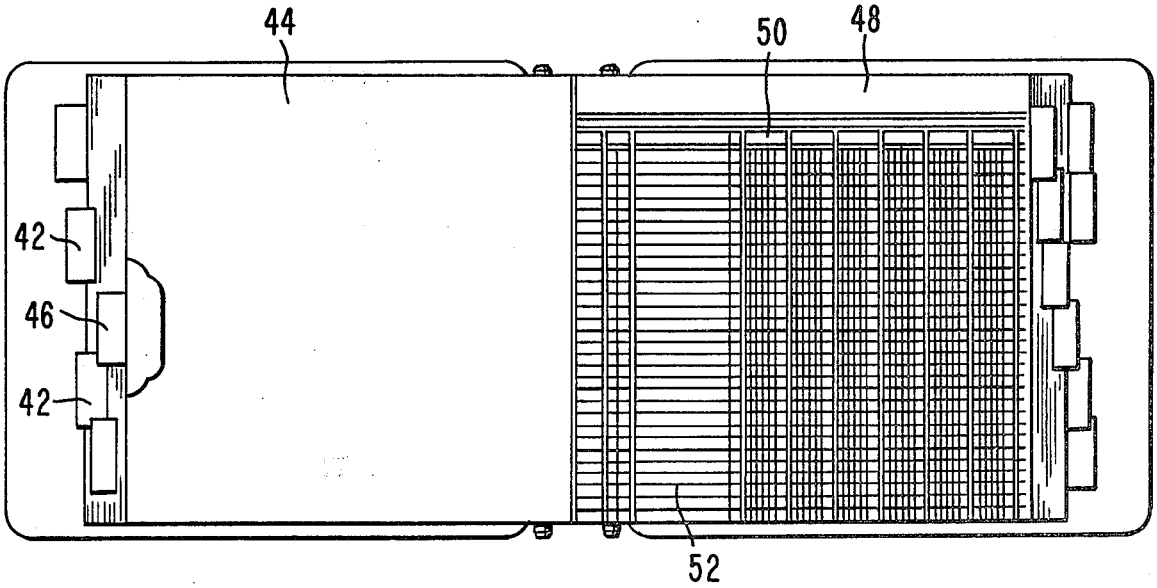
FIG. 2 is a plan view of the invention opened to the first page of one of the accounts contained therein showing the index tab and separator and the ruled bookkeeping paper appropriate to that account.

Turning to FIG. 2, the *Multiple Account Bookkeeping Book* is opened to the beginning of one of the accounts near the middle of the book. A separator 44 has affixed a specific index tab 46 which is positioned in a staggered position with regard to the remainder of the index tabs 42 so that an inscription placed thereon regarding the type of account will be visible when the book is opened. A representative sheet of paper 48 having columns 50 and rows 52 appropriate to a particular account is depicted; however, it should be appreciated that the arrangement of rows 52 and columns 50 will vary according to the particular accounts employed in the module.

Figure 3:
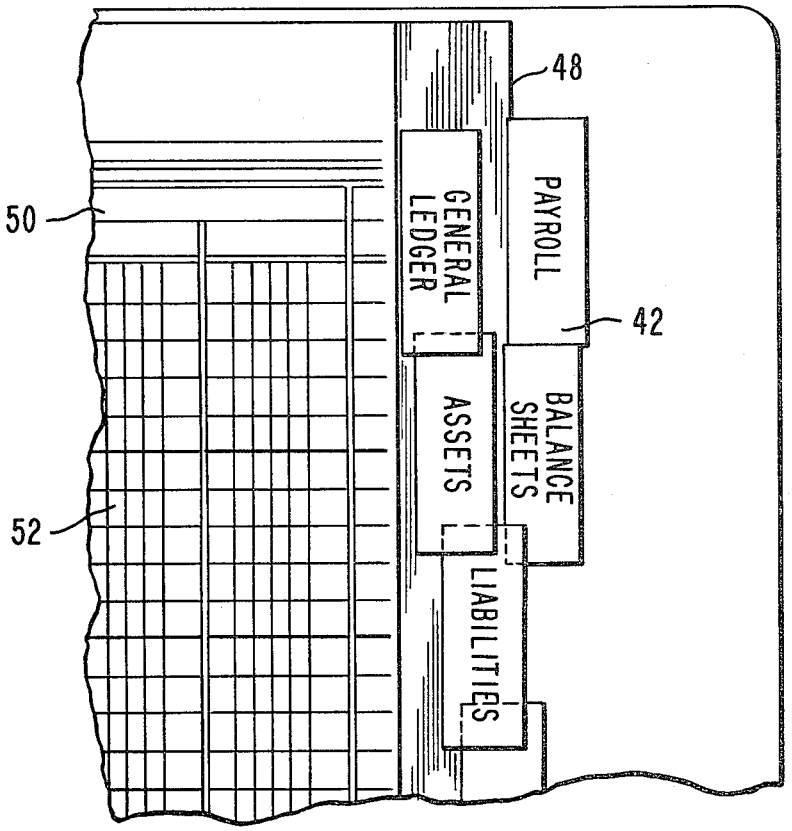
FIG. 3 is an enlarged fragmentary view of the upper right corner of FIG. 2 showing typical index tabs with inscriptions for some of the accounts contained in the book.

FIG. 3 showing an enlarged fragmentary view of the upper right corner of FIG. 2 shows more clearly index tabs 42 at various points within pages 48 as well as rows 52 and columns 50 of the page to which the book is opened in FIG. 2.

FIG. 3 further illustrates a number of the typical tabs with inscriptions showing accounts likely to be included in the modular unit, however the invention is not limited to these accounts depicted. In fact, some of them may be subdivided, such as "assets", may be divided into "current assets" and "fixed assets", and "accounts receivable" or "accounts payable" could also be included. Additionally, within each account there would be column headings which could be pre-printed.

Figure 4:
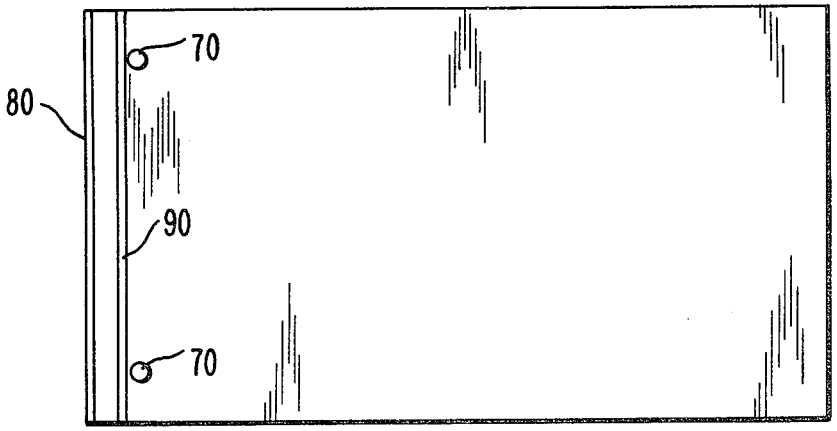
FIG. 4 is a typical sheet employed in the module showing the unique cooperation and positioning of adhesive strips, which initially create the module, allow expansion of the module during the accounting period, and which further are adapted to form the module into a bound volume at the conclusion of the accounting period.

Referring now particularly to FIGS. 1 and 4, it can be seen that the module 38 comprises a plurality of apertured sheets 48 and separators 44 having two distinct strips of adhesive material coated on the portion of the module 38 which is clamped by the binder 20.

A strip of thermo-setting or heat actuated adhesive 80 is coated on the captive edge of the individual sheets and separators which comprise the module 38, and a strip of pressure sensitive adhesive 90 is coated intermediate the thermo-setting adhesive 80 and the apertures 70. The purpose for this arrangement is twofold; the pressure sensitive adhesive 90 is intended to loosely bind the sheets and separators together to form the module core before and after insertion into the binder, and during the entry of items into the individual accounts; and the heat actuated adhesive is intended to form a permanent binding for the module after all of the entries have been made for a given accounting period.

By choosing a pressure sensitive adhesive, which will only loosely bind the adjacent sheets and separators, allows the module to be expanded when necessary to accommodate additional sheets 48. The weak temporary bond afforded by the pressure sensitive adhesive between adjacent sheets allows the module to be manually separated into upper and lower loosely bound components. The upper component is removed from the posts 32 and 34 as a unit, and the additional sheets or plurality of sheets are inserted onto the posts 32 and 34. The cooperation of the posts 32 and 34 with the apertures 70 aligns the adhesive strips 80 and 90 of the additional sheets with the upper and lower module components when the module is re-assembled in the binder. The clamping force of the binder 20 re-establishes the loose bond created by the pressure sensitive adhesive strip 90 and the module is once again a cohesive unit.

After all the entries have been made in the module for a given fiscal period, the edge of the module 38 is exposed to heat and the thermo-setting adhesive strip 80 is liquified and penetrates the adjacent sheets 48 and separators 40 to form a permanent binding for the modular fiscal year account book of the instant invention.

The pressure sensitive adhesive affords a temporary bond for the module which maintains the alignment of the sheets when the module is being inserted into the binder, and also provides the expansion capability for the module while maintaining the alignment of the sheets which comprise the upper and lower components respectively during the insertion of additional sheets.

In FIGS. 1 and 4 the adhesive strips 80 and 90 are shown as coated on only one side of the sheets and separators; however, both sides of the sheets and separators may be coated in keeping with the breadth and scope of this invention.

Having described the preferred embodiment of the invention, it should be understood that various changes in construction and arrangement would be apparent to those skilled in the art, and are fully contemplated here without departing from the true spirit of the invention. Accordingly, there are covered all alternatives, modifications, and equivalents as may be included in the spirit and scope of the invention as defined solely by the appended claims.

What I claim is:

1. A core for a modular fiscal period account book comprising:

a multiplicity of sheets having a row of apertures disposed proximate one edge of each of said sheets, a strip of thermo-setting adhesive disposed on at least one side of each of said sheets, intermediate the said apertures and the said one edge, and a strip of pressure-sensitive adhesive disposed on at least one side of each of said sheets, proximate said row of apertures for releasably bonding said multiplicity of sheets together.

2. A core for a modular fiscal period account book as in claim 1; wherein the said strip of pressure sensitive adhesive is disposed intermediate the said row of apertures and said strips of thermo-setting adhesive.

3. A core for a modular fiscal period account book as in claim 1; wherein the said row of apertures is disposed intermediate said strip of thermo-setting adhesive and said strip of pressure sensitive adhesive.

* * * * *